US008997995B2

(12) United States Patent
Chitsazan

(10) Patent No.: US 8,997,995 B2
(45) Date of Patent: Apr. 7, 2015

(54) BEVERAGE TRANSPORT ORGANIZER

(71) Applicant: Adam Chitsazan, Grapevine, TX (US)

(72) Inventor: Adam Chitsazan, Grapevine, TX (US)

( * ) Notice: Subject to any disclaimer, the term of this patent is extended or adjusted under 35 U.S.C. 154(b) by 43 days.

(21) Appl. No.: 14/073,271

(22) Filed: Nov. 6, 2013

(65) Prior Publication Data

US 2014/0353181 A1 Dec. 4, 2014

Related U.S. Application Data

(60) Provisional application No. 61/828,236, filed on May 29, 2013.

(51) Int. Cl.
*A45C 11/20* (2006.01)
*B65D 25/28* (2006.01)

(52) U.S. Cl.
CPC ..... *B65D 25/2858* (2013.01)

(58) Field of Classification Search
CPC ..... B65D 71/72; B65D 5/5021; B65D 2571/00925; B65D 5/4802
USPC ..... 206/562, 563, 564, 565, 486, 490, 427, 206/428, 541, 549, 503, 504, 542; 229/902, 229/904; 220/592.16, 592.17, 495.03, 528, 220/556, 737, 740
See application file for complete search history.

(56) References Cited

U.S. PATENT DOCUMENTS

| | | | | |
|---|---|---|---|---|
| 4,607,758 | A * | 8/1986 | Stevens | 220/23.83 |
| 5,938,060 | A * | 8/1999 | Rutland, Jr. | 220/23.6 |
| 6,186,351 | B1 * | 2/2001 | Coyle | 220/23.83 |
| 6,519,965 | B1 * | 2/2003 | Blanchard et al. | 62/264 |
| 6,851,276 | B2 * | 2/2005 | Perrins | 62/457.5 |
| 7,178,673 | B1 * | 2/2007 | Miller | 206/545 |
| 7,562,787 | B2 * | 7/2009 | Serrano | 220/507 |
| 7,780,034 | B1 * | 8/2010 | Richardson | 220/592.18 |
| 7,861,552 | B1 * | 1/2011 | Hughes | 62/457.2 |
| 2005/0029272 | A1 * | 2/2005 | Padilla | 220/735 |

* cited by examiner

*Primary Examiner* — Jacob K. Ackun, Jr.
*Assistant Examiner* — Jenine Pagan

(57) ABSTRACT

The beverage transport organizer is an apparatus system that provides a user with a facilitated means of transporting a plurality of different beverage vessels. The apparatus system utilizes a beverage carrier and an insert panel. The beverage carrier is a container that holds the plurality of different beverage vessels during transport. The insert panel is positioned within the beverage carrier and provides a means of organizing beverage vessels for transport. The insert panel uses particularly shaped holders that accommodate beverage vessels of varying shapes and sizes. The beverage holders of the insert panel prevent beverage vessels from hitting against each other during transport, reducing the broken or chipped glassware.

15 Claims, 6 Drawing Sheets

BEVERAGE TRANSPORT ORGANIZER

The current application claims a priority to the U.S. Provisional Patent application Ser. No. 61/828,236 filed on May 29, 2013.

FIELD OF THE INVENTION

The present invention relates generally to food and beverage transportation apparatuses such as trays and picnic baskets. More specifically, the present invention is a beverage glass transport and organize which is designed to enable a user to transport beverage glasses in an organized and efficient manner which helps to prevent the glasses from becoming either lost or broken.

BACKGROUND OF THE INVENTION

In the restaurant business it is typical for drinks to be served accompanying the food. In most restaurants a server initially take the drink orders of the customers once the customers have been seated at a table. This gives the customers some time to peruse the menu and decide what appetizers and entrees they would like to order. In most sit-down restaurants, beverages are served in glasses which are manufactured from the material glass, and are completely open at the top. A beverage is poured into the glass and the glass is then transported to the customer's table for their consumption. The fact that most glasses are completely open at the top means that it is necessary for the server to keep the glasses level when delivering them to the customer's table. Tipping the glasses too far in any direction results in spilling of the liquid which is contained within the beverage glass. This can cause issues if the spill is in a well traveled area and on a smooth surface; the spill can potentially cause other servers who subsequently pass through the area to slip and spill more liquid or drop food on the ground. This results in lost product and often times broken dishes which is a cost that most restaurants prefer to avoid as much as possible.

There are several different methods currently utilized to deliver beverage glasses to the customer's table. If only one or two customers are present, then it is possible for the server to simply carry the beverage glasses using their hands. This method carries the lowest risk of spilling the beverage or dropping the glasses, but is inefficient due to the fact that the server can only carry two beverage glasses at once. A more efficient method that is commonly used is to utilize a tray to carry multiple beverages at once. In use, the tray is set down and the beverages are transferred onto the tray and then the server pick up the tray and carries it to the customer's table. There is no support for the beverages apart from the surface of the tray, and therefore it is very easy for the beverages to slide on the tray or even fall off of the tray if the tray is subjected to any tipping or sudden impacts. If a server carrying a tray loaded with beverages is bumped or slips, it is very likely that the beverage glasses will slide, tip, and potentially fall to the ground and be destroyed. This is very costly for the restaurant as they are losing items vital to the operation of the restaurant, and are wasting employee labor by having to clean up the mess which results from glass breakage. Furthermore, it is important to note that the more beverages place on the tray, the higher the risk involved with carrying the tray as the increased weight can make it easier for the server to lose control of the tray. It is clear that the average tray provides insufficient support to prevent the chance of costly and time consuming spills and breakages.

Based upon the issues discussed above, it is clear that there is need for a new apparatus which is superior to the tray for transporting beverages to the customer's table. As result of this fact, it is an object of the present invention to create an apparatus which is capable of carrying a plurality of beverages securely. It is an object of the present invention to provide horizontal support to the plurality of beverages in addition to the vertical support used to carry the plurality of beverages. The horizontal support helps to prevent the beverages form sliding around should the present invention be tilted, bumped, or jostled. It is a further object of the present invention to provide a retaining wall whose height is sufficient to contain any liquid that may spill from the glasses should the present invention be tilted, bumped, or jostled. It is an additional object of the present invention to be easily carried in one hand such that two of the present invention can be carried by one server, thereby greatly augmenting that server's drink transporting abilities. The present invention may also be capable of transporting straws which are commonly used in restaurants to allow the customers to drink their beverages without putting their mouths on the edge of the glass. It is a further object of the present invention to also be stackable such that it can be easily stored in a space efficient manner. Still another object of the present invention is to provide a server with the ability to carry a greater quantity of beverages in a single trip, allowing them to expeditiously deliver beverages to multiple tables and guests. Still another object of the present invention is to provide a safer alternative to existing beverage transport system by lowering the center of gravity during beverage transportation, reducing accidental slips and falls that could cause serious injury to the server and result in worker compensation disputes as well as possible personal injury lawsuit to a restaurant owner.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
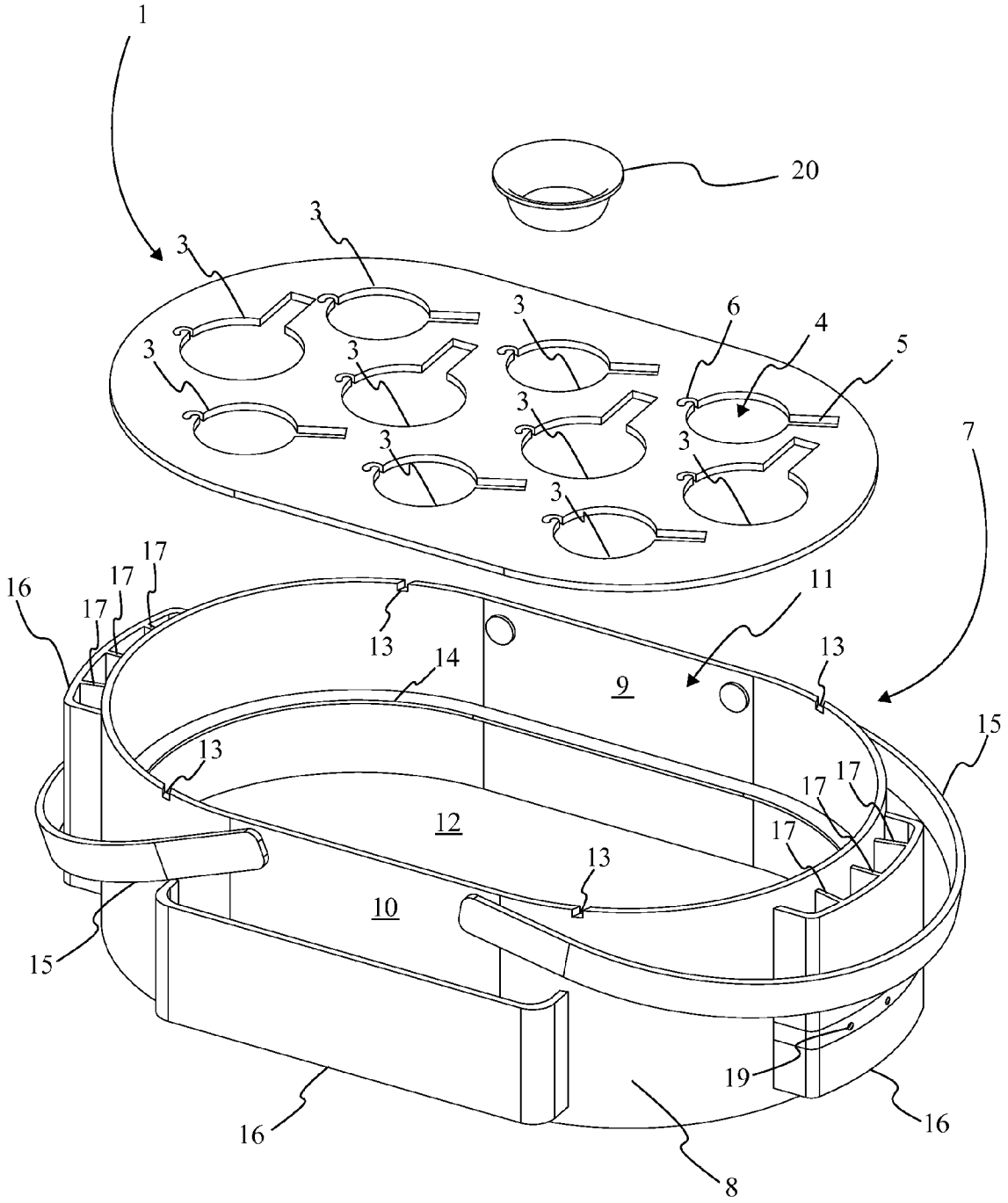
FIG. 1 is an expanded top perspective view displaying the insert panel, the beverage carrier, and the secondary holder as per the current embodiment of the present invention.
Figure 5:
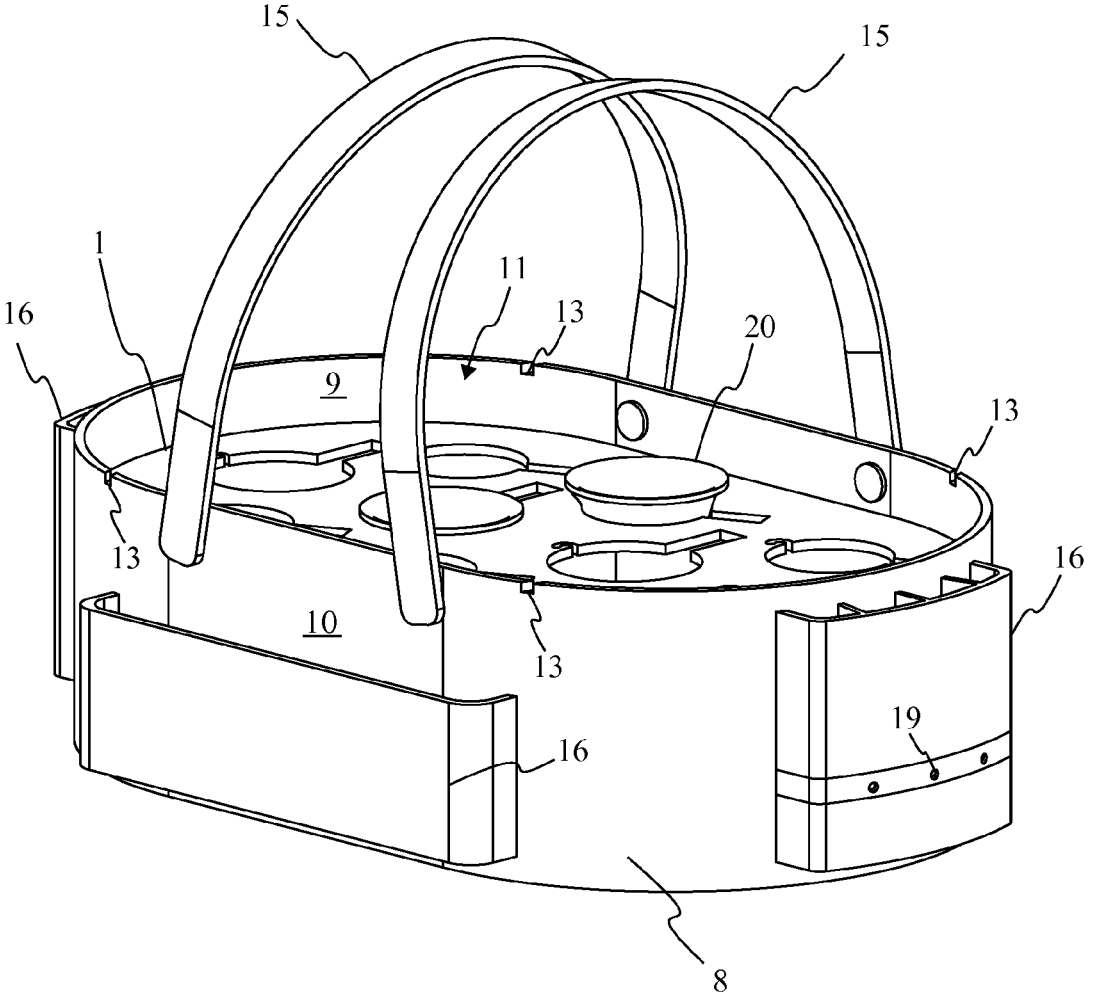
FIG. 5 is a perspective view displaying the pair of handles positioned to be single handedly engaged by a user, as per the current embodiment of the present invention.

Referencing FIG. 1 and FIG. 5, the beverage transport organizer is an apparatus system that provides a user with a facilitated means of transporting a plurality of different beverage vessels. The apparatus system comprises a beverage carrier 7 and an insert panel 1. The beverage carrier 7 is a container that holds a plurality of different beverage vessels during transport. The beverage carrier 7 utilizes the insert panel 1 as a means of organizing beverage vessels of various sizes and shape for transport. The insert panel 1 uses particularly shaped holders that distribute and accommodate various beverage vessels, preventing them from hitting against each other during transport.

Figure 2:
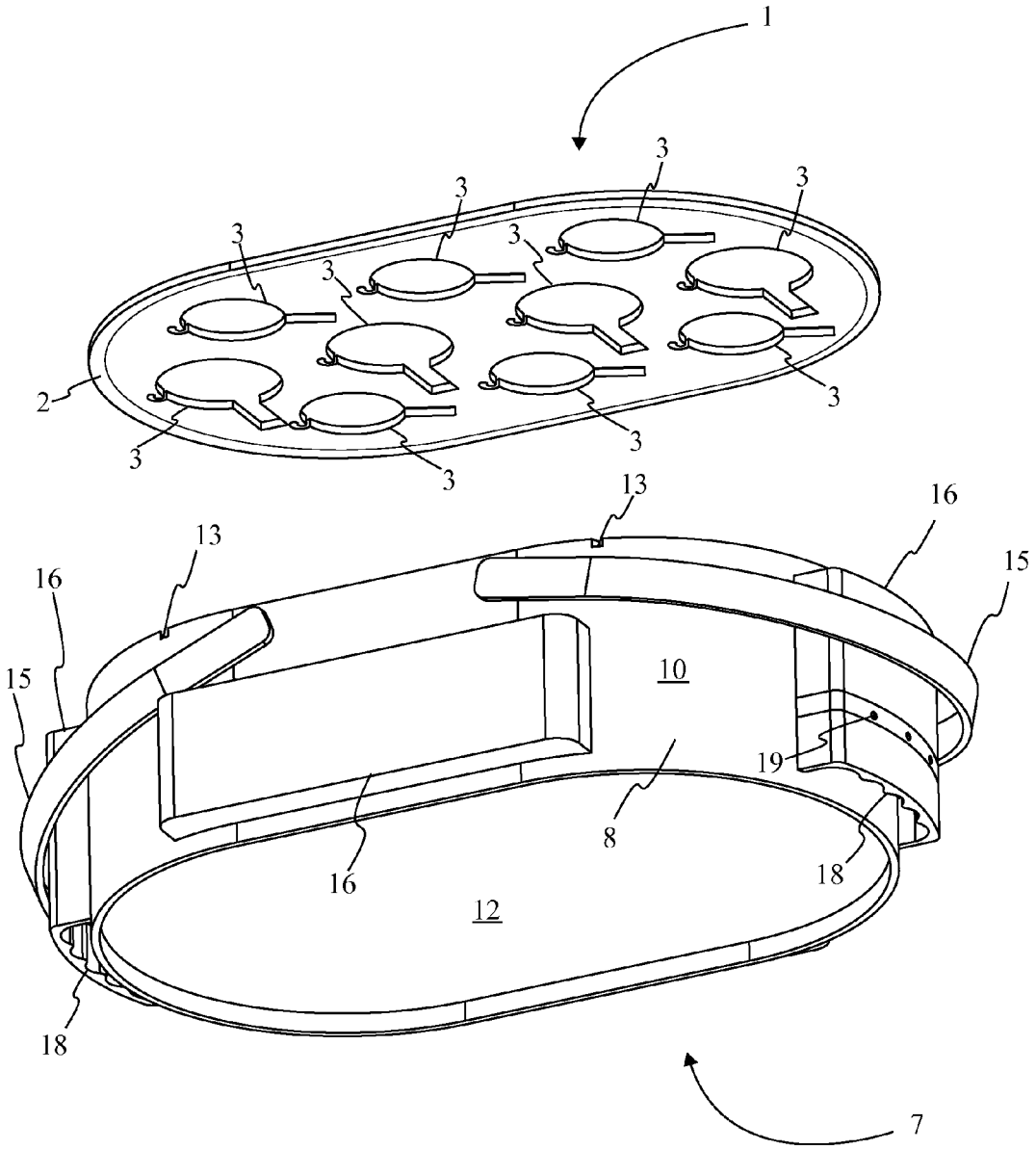
FIG. 2 is an expanded bottom perspective view displaying the insert panel and the beverage carrier as per the current embodiment of the present invention.
Figure 3:
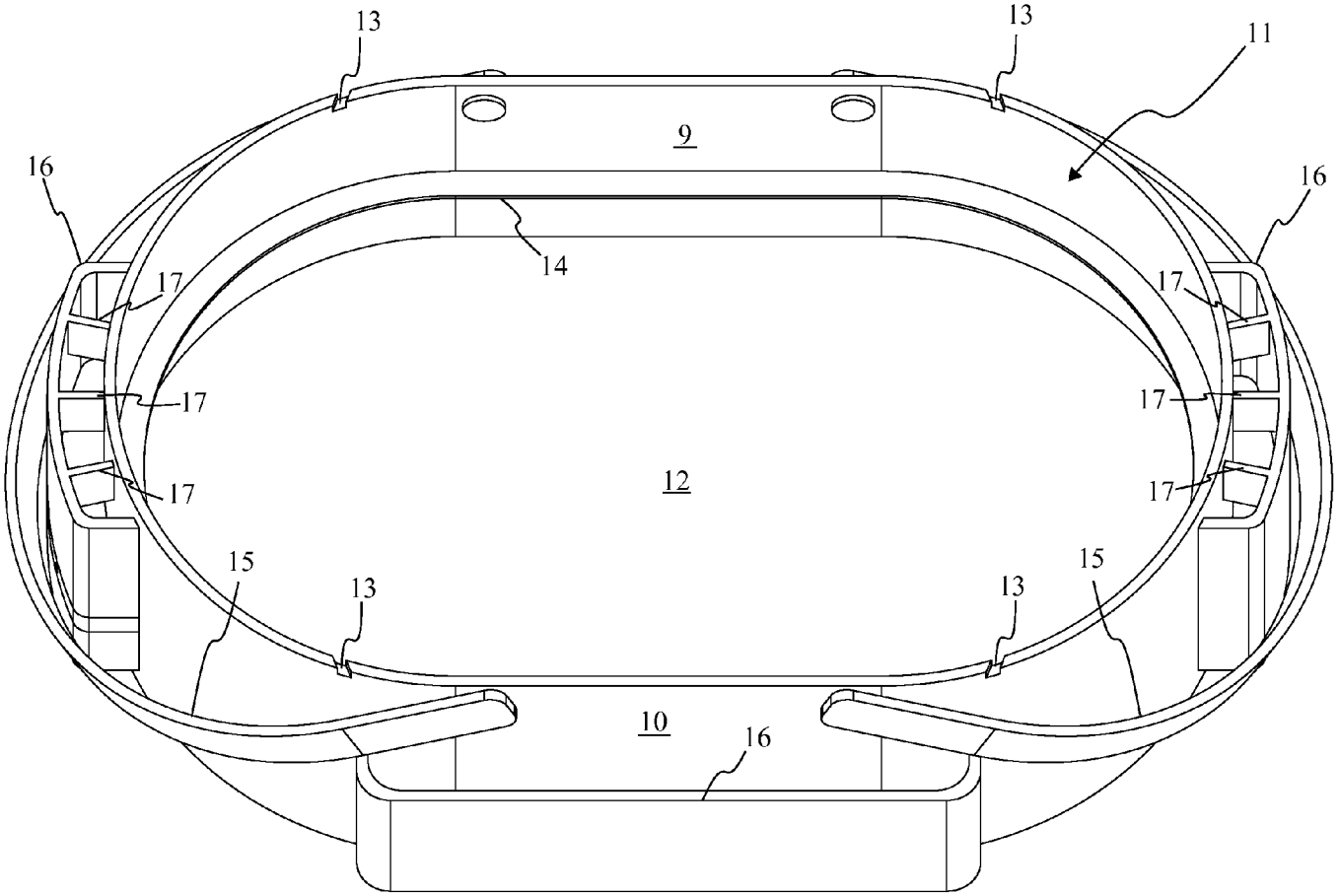
FIG. 3 is a top down perspective view displaying the interior portion of the beverage carrier as per the current embodiment of the present invention.

Referencing FIG. 1-3, the beverage carrier 7 functions as a container that transports large quantities of beverage vessels of varying size and shape. The beverage carrier 7 is particularly shaped to balance the weight of a large quantity of beverage vessels that are being transported. The beverage carrier 7 is provided with specific features that permit it to be stacked on top of other beverage carriers 7 in order to save space when being stored. In the current embodiment of the present invention the beverage carrier 7 comprises a lateral wall 8, a carrier opening 11, a bottom panel 12, stacking notches 13, a panel mount 14, a pair of handles 15, and a plurality of container pockets 16. The lateral wall 8 is a rigid structure that is the most visible exterior portion of the beverage carrier 7. The carrier opening 11 is the entrance through which beverage vessels are positioned into and taken out of the beverage carrier 7. The bottom panel 12 encloses the lower portion of the lateral wall 8 and functions as a base for the beverage carrier 7. The stacking notches 13 are structural elements that are positioned on the lateral wall 8 and function as a means of stacking a beverage carrier 7 on top of another beverage carrier 7 in order to save storage space. The panel mount 14 is provided as a particularly positioned engagement point for the insert panel 1. The pair of handles 15 function as a user engageable means of manipulating the beverage carrier 7 for transport. The plurality of container pockets 16 are provided as structures that serves as storage location for various items commonly associated with beverages such as straws, napkins, and coasters.

Referencing FIG. 1-3, the beverage lateral wall 8 functions as the rigid structure that laterally surrounds beverage vessels contained within the beverage carrier 7. The carrier opening 11 and the bottom panel 12 are positioned opposite to each other across the lateral wall 8. While the bottom panel 12 is positioned on the lower portion of the lateral wall 8 forming a base for the beverage carrier 7, it should be noted that the bottom panel 12 can be slightly recessed within the lateral wall 8. In the configuration that provides the bottom panel 12 as being slightly recessed within the lateral wall 8, the terminal end of the lateral wall 8 adjacent to the bottom panel 12 would function as the base for the beverage carrier 7. In the aforementioned configuration recessed bottom panel 12 would still function as the lower surface upon which beverage vessels would rest on top of but would additionally function as a means of providing structural support to portion of the lateral wall 8 coincident with a surface.

Referencing FIG. 1-3, the lateral wall 8 functions as the engagement for the stacking notches 13, the bottom panel 12, the pair of handles 15, and the plurality of container pockets 16. It should be noted that the geometry of the lateral wall 8 can directly influence the geometry of the bottom panel 12 and the insert panel 1. While the lateral wall 8 is depicted with a particular geometry in FIG. 1-6, it should be noted that the lateral wall 8 can be provided in any geometry that accommodates various beverage vessels of varying size and shape. Furthermore the possible geometries of the lateral wall 8 should not structurally compromise the functionality of the beverage transport organizer.

Referencing FIG. 1-3, in the current embodiment of the present invention, the lateral wall 8 comprises an inner wall 9 and an outer wall 10. The inner wall 9 and the outer wall 10 are distinct from each other due to the particular engagements with the panel mount 14 and the plurality of container pockets 16, respectively. The inner wall 9 is the interior face side of the lateral wall 8. The outer wall 10 is the exterior portion of the lateral wall 8. The inner wall 9 is surrounded by the outer wall 10. The panel mount 14 is found engaged to the inner wall 9 between the carrier opening 11 and the bottom panel 12. The plurality of container pockets 16 are peripherally positioned on the outer wall 10. Although the engagement between the inner wall 9 and the panel mount 14 are not described as being explicitly different from the engagement between the plurality of the container pockets 16 and the outer wall 10, the engagement between the inner wall 9 and the panel mount 14 may be adjustable permitting the panel mount 14 to change position between the bottom panel 12 and the carrier opening 11.

Referencing FIG. 3, the carrier opening 11 is the portion of the beverage carrier 7 that permits beverage vessels to be placed into and taken out of the beverage carrier 7. The carrier opening 11 is bordered by the lateral wall 8. The carrier opening 11 is always found opposite the location of the bottom panel 12 across the lateral wall 8. Although the dimensions of the carrier opening 11 are influenced by the geometry of the lateral wall 8, the carrier opening 11 should be appropriately sized to enable passage of the insert panel 1 in order to engage the panel mount 14.

Referencing FIG. 2 and FIG. 3, the bottom panel 12 is a structural component that encloses the lateral wall 8 forming the main body section of the beverage carrier 7. The bottom panel 12 also serves as the surface upon which beverage vessels are rested on top of. The bottom panel 12 can be recessed within the lateral wall 8 or can be positioned terminally to the lateral wall 8. In the recessed position, the lateral wall 8 extends beyond the engagement with the bottom panel 12 and functions as the contacting surface for the beverage carrier 7. In the terminal positioning, the lateral wall 8 does not extend beyond its engagement with the bottom panel 12 permitting the bottom panel 12 to functions as the base for the beverage carrier 7.

Figure 6:
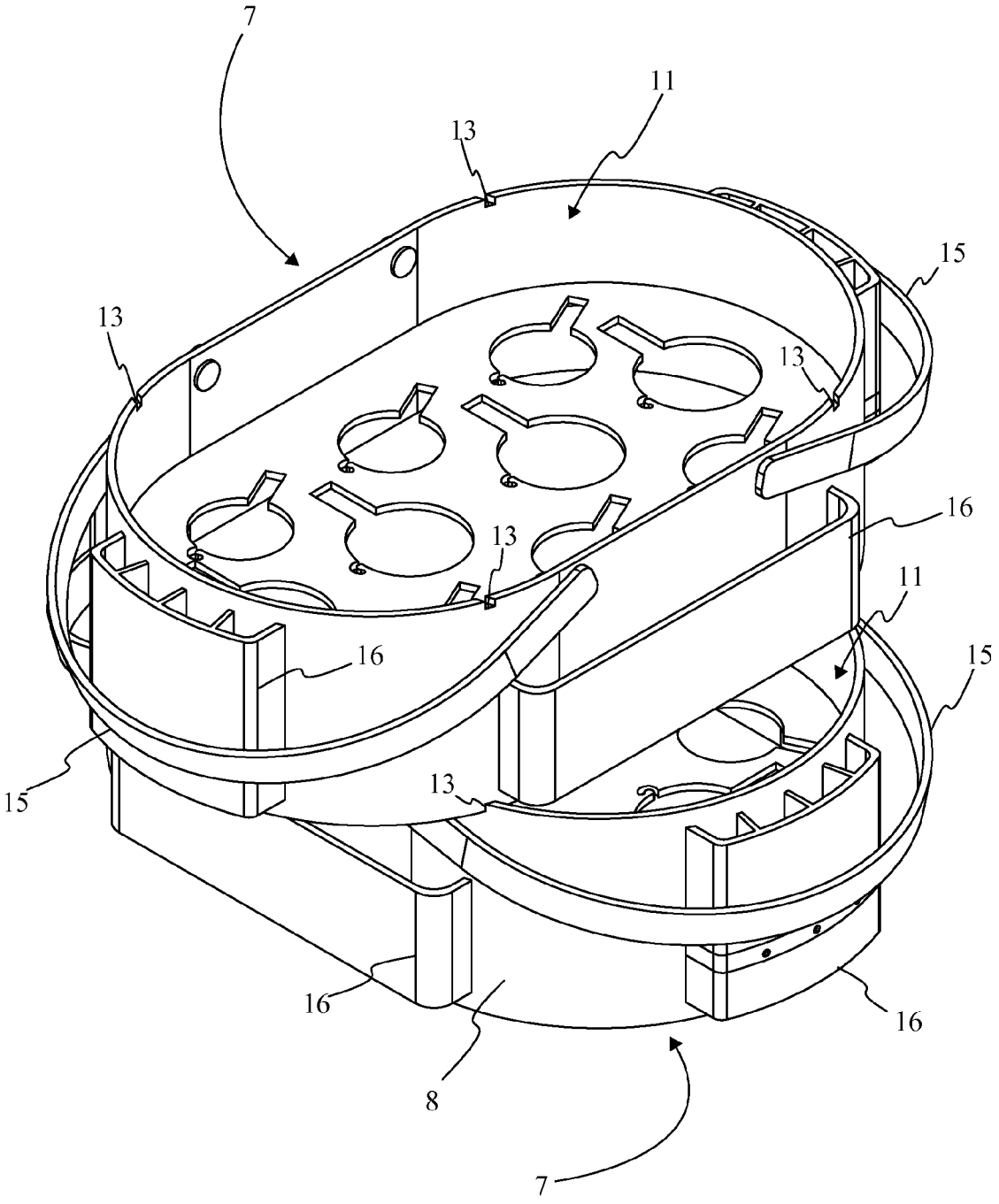
FIG. 6 is a perspective view displaying the stackability of the beverage carrier as per the current embodiment of the present invention.

Referencing FIG. 3 and FIG. 6, the stacking notches 13 are provided as structural features that permit the beverage carrier 7 to be stacked on top of another beverage carrier 7. The stacking notches 13 provide the beverage transport organizer with a means of increasing storage space. The stacking notches 13 are found positioned on the lateral wall 8 surrounding the carrier opening 11. The stacking notches 13 are spaced a distance that is roughly equivalent to the width of the bottom panel 12. The distance between stacking notches 13 provides a space that functions as a mounting point for another beverage carrier 7. In order to stack a beverage carrier 7 on top of another beverage carrier 7, the beverage carrier 7 being positioned on top of the other beverage carrier 7 is brought into alignment with the stacking notches 13. The stacking notches 13 require the beverage carrier 7 to be angled across the lower positioned beverage carrier 7. It should be noted that while the current embodiment utilizes stacking notches 13, an alternative embodiment could directly stack beverage carriers 7 with the bottom panel 12 of beverage carrier 7 becoming coincident with the panel mount 14 of another beverage carrier 7.

Referencing FIG. 1 and FIG. 3, the panel mount 14 is an engagement point that is detachably coupled to the insert panel 1. The panel mount 14 is found coupled to the inner wall 9 between the carrier opening 11 and the bottom panel 12. The distance between the panel mount 14 and the bottom panel 12 is provided as being less than the distance between the base and the bowl of a standard wine glass. This measurement requirement is provided in order to permit a standard wine glass to be securely held in the beverage carrier 7 by the insert panel 1. In an alternative embodiment, the panel mount 14 is adjustable in its positioning. The adjustable positioning of the panel mount 14 would permit the accommodation of non-standard wine glasses. In order to accomplish, the inner wall 9 could provide a mechanism that the detachably engages the panel mount 14.

Referencing FIG. 1 and FIG. 5, the pair of handles 15 are provided as a means of transporting the beverage carrier 7. The pair of handles 15 provide a user with a means of engaging the beverage carrier 7 with a single hand, facilitating transport. The pair of handles 15 are found pivotably engaged to the lateral wall 8, proximal to the carrier opening 11. The pivotable engagement of the pair of handles 15 allows each handle to pivot between a position coincident with the lateral wall 8 to a position in with the pair of handle are coincident with themselves. The handles of the pair of handles 15 are symmetrically positioned on the lateral wall 8 in order to provide balance when transported by a user.

Referencing FIG. 2 and FIG. 3, the plurality of container pockets 16 are provided as storage compartments that hold items commonly associated with beverages including but not limited to napkins, straws, and coasters. The plurality of container pockets 16 are perimetrically positioned on the lateral wall 8. Specifically the plurality of container pockets 16 are found engaged to the outer wall 10. The plurality of container pockets 16 are symmetrically distributed on the outer wall 10 in order to ensure balance to the beverage carrier 7 when transported. In the current embodiment of the present invention the plurality of container pockets 16 comprise partitions 17 and ergonomic handles 18. The partitions 17 are provided as organizational features that separate regions within a container pocket of the plurality of container pockets 16 in order to designate storage locations for specific items. The ergonomic handles 18 are formed features built into a container pocket of the plurality of container pockets 16 that provides a secondary engagement means to the pair of handles 15. The ergonomic handles 18 are formed to accommodate a user's hands. The ergonomic handles 18 are found positioned adjacent to the bottom panel 12. The ergonomic handles 18 are found positioned on opposing container pockets 16 of the plurality of container pockets 16 in order to ensure better grip by a user.

Figure 4:
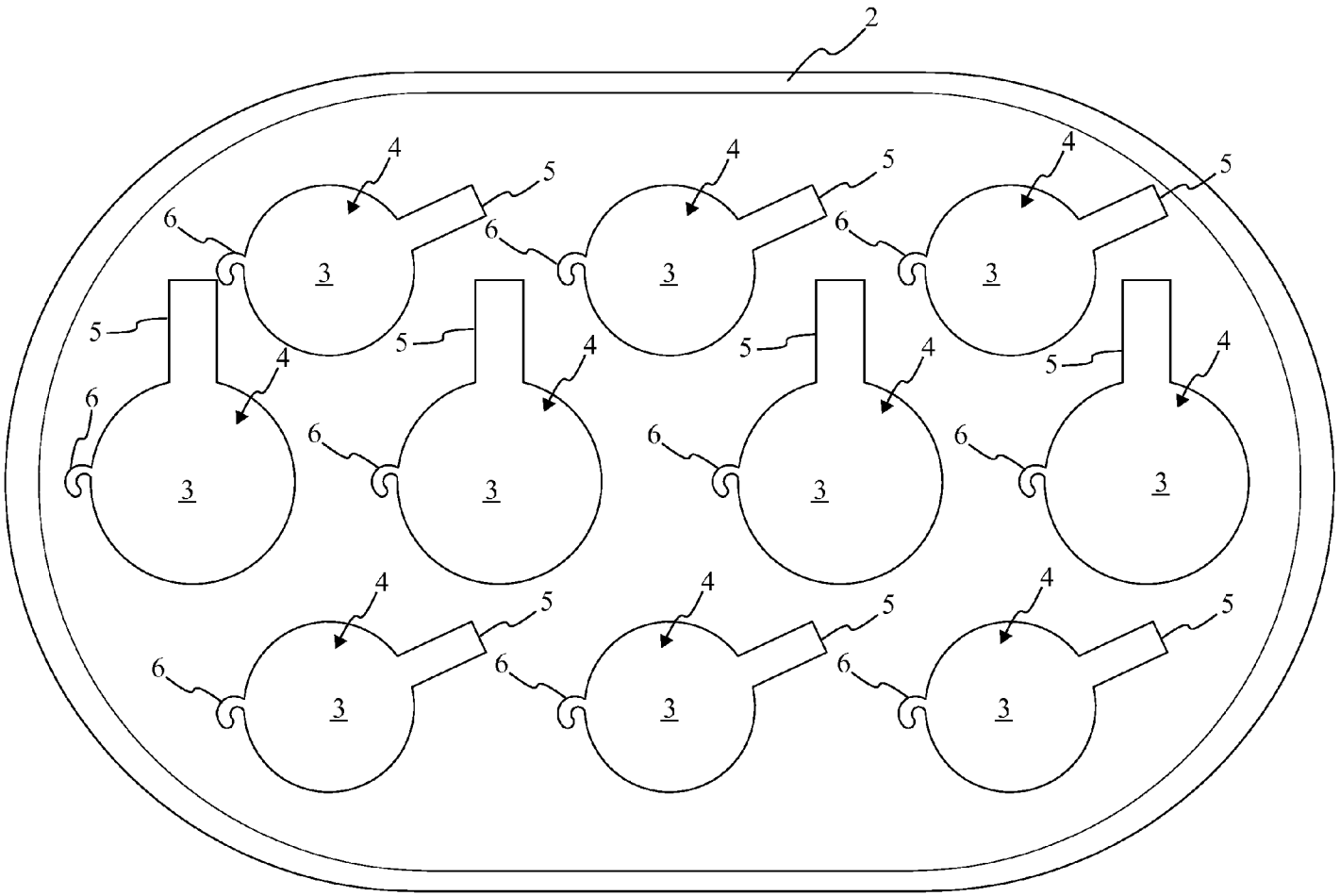
FIG. 4 is a bottom elevational view displaying the lower portion of the insert panel as per the current embodiment of the present invention.

Referencing FIG. 3 and FIG. 4, the insert panel 1 is provided as the means of organizing beverage vessels positioned within the beverage carrier 7. The insert panel 1 distributes and secures beverage vessels within in a beverage carrier 7 in order to prevent unwanted movement of the beverage vessels during transport. The insert panel 1 is rigid in construction and has a generally planar shape. The insert panel 1 is detachably engaged to the panel mount 14 of the beverage carrier 7. The insert panel 1 traverse through the carrier opening 11 in order to engage the panel mount 14. In the current embodiment of the present invention, the insert panel 1 comprises a carrier mount 2 and a plurality of beverage holders 3. The carrier mount 2 is the portion of the insert panel 1 that detachably engages the panel mount 14. The plurality of beverage holders 3 are ports with specific features designed to accommodate and securely retain a variety of beverage vessels. The plurality of beverage holders 3 are found symmetrically distributed on the insert panel 1. The symmetrical distribution allows for a user to evenly distribute beverage vessels within the beverage carrier 7 for better balance when transporting the beverage carrier 7.

Referencing FIG. 4, the plurality of beverage holders 3 each comprise a circular opening 4, a beverage handle opening, and a glassware stem holder 6. The circular opening 4 permits the base of a beverage vessel to traverse the insert panel 1 and become coincident with the bottom panel 12. The circular opening 4 also provides an engagement surface the cylindrical body of the beverage vessel. It should be noted that the circular opening 4 of a beverage holder 3 may be of a different dimension then the circular opening 4 of another beverage holder 3 on the same insert panel 1. The variation in dimension between circular openings 4 of different beverage holders 3 is provided as a means of accommodating a larger variety of beverage vessels with the same insert panel 1. The beverage handle opening is peripherally positioned to the circular opening 4 and functions as an opening specifically designed for the handle of a beverage vessel which include but are not limited to mugs and Seidel style glassware. The glassware stem holder 6 it provided as an engageable feature for securely retaining the stem portion of various pieces of glassware. The glassware stem holder 6 is peripherally positioned to the circular opening 4. The glassware stem holder 6 contains specific curvatures that prevent an engaged piece of glassware from moving during transport. The specific curvatures accomplish this by requiring a piece of glassware to move in particular manner in order to become disengaged. It should be noted that while the current embodiment of the present invention describes the plurality of beverage holders 3 as comprising the circular opening 4, the beverage handle opening, and the glassware stem holder 6, that each of the plurality of beverage holders 3 is not required to contain all the aforementioned components. It should be noted that the engagement between a wine glass stem and the glassware stem holder 6 is provided as being a detachable engagement that locks the wine glass stem in place during transport but can be disengaged as needed by the user.

Referencing FIG. 1, in an embodiment of the present invention, the beverage transport organizer comprises a secondary holder 20. The secondary holder 20 is provided as a means of accommodating beverage vessels that are shorter than the distance between the insert panel 1 and the bottom panel 12. The secondary holder 20 is removeably inserted into a beverage holder 3 of the plurality of beverage holders 3. The secondary holder 20 partly traverses the circular opening 4 until the exterior portion of the secondary holder 20 becomes coincident with the edge of the circular opening 4. The secondary holder 20 is particularly shaped allowing it to be partially sleeved by the circular opening 4 of the beverage holder 3 but still permitting it to be removed with ease if needed. The secondary holder 20 is outwardly curved from its base as a means of accommodating various small beverage vessels.

Referencing FIG. 1, FIG. 2, and FIG. 5, in an embodiment of the present invention, the beverage carrier 7 comprises an illumination device 19. The illumination device 19 is a lighting array that is optically disposed at an angle towards the ground, wherein the disposed vector of the illumination device 19 is oriented towards the ground when the beverage carrier 7 is being transported by a user. The illumination device 19 provides a means of illuminating the path which a user is transporting the beverage carrier 7. The illumination device 19 is mounted to the outer wall 10, but it should be noted that the illumination device 19 can be integrated into a container pocket of the plurality of container pockets 16. While the illumination device 19 is provided as being mounted to the outer wall 10 and being optically disposed towards the ground, it should be noted that in additional embodiments, the illumination device 19 may be positioned anywhere on the beverage carrier 7 as its function would not be relegated to illuminating a user's path. In this embodiment, the illumination device 19 could be provided as a visual identifier for the user as well as an aesthetic piece.

In an embodiment of the invention, the beverage transport organizer is designed to allow restaurant servers to more efficiently and more securely transport a plurality of beverages to a table. The invention comprises the beverage carrier 7 and the organization panel, and a pair of handles 15. The body of the invention is the main component of the invention and further comprises a bottom panel 12 and a lateral wall 8. The bottom panel 12 provides a platform upon which the plurality of beverages rest. The height, width, and thickness of the bottom panel 12 may vary in the final embodiment of the invention depending upon the materials used in its manufacturing. The bottom panel 12 is very flat and smooth, and is rigid enough to support a plurality of beverages without excessive deformation. There are many different materials which may potentially be used in the manufacture of the bottom panel 12, however it is necessary that the material used be rigid enough to support the weight of the plurality of beverages. Some examples of materials which may be used in the manufacture of the bottom panel 12 include but are not limited to plastics and metals.

In an embodiment of the invention, the lateral wall 8 is directly connected to the perimeter of the bottom panel 12 and is intended to fulfill the object of containing any spilled liquid should the invention be tilted or bumped when it is in use. The lateral wall 8 protrudes upwards from the bottom panel 12 such that a storage volume which is closed on all sides but the top is created. The storage volume represents where the plurality of beverages are placed when the invention is in use. The lateral wall 8 is most likely manufactured from the same materials as the bottom panel 12 and is directly connected to the bottom panel 12. The shape of the lateral wall 8 mirrors the shape of the bottom panel 12. Furthermore, the dimensions of the lateral wall 8 may vary depending upon the design requirements of the final embodiment of the invention. For example, the height of the lateral wall 8 with respect to how far it protrudes upwards from the bottom panel 12 may vary depending on what type of glass the invention is intended to be used with; the lateral wall 8 may be shorter for glasses such as mugs, and taller for glasses such as champagne glasses.

In an embodiment of the invention, the lateral wall 8 further comprises a plurality of handle holes, and a plurality of stacking notches 13. The plurality of handle holes are drilled through the lateral wall 8 near its top edge and are distributed such that the pair of handles 15 may be rotatably attached to the body. The positioning of the plurality of handle holes may vary in the final embodiment of the invention depending upon weight distribution of the invention. The positioning of the plurality of handle holes directly affects the positioning of the pair of handles 15. It is therefore very important to be mindful of the placement of the plurality of handle holes as their positioning affects the overall balance of the invention when it is carried via the pair of handles 15. The plurality of stacking notches 13 are small rectangular cuts into the material of the lateral wall 8. The plurality of stacking notches 13 are intended to improve the stackability of the invention and are therefore located along the top edge of the lateral wall 8. The bottom edge of the lateral wall 8 fits into the plurality of stacking slots when multiple of the invention are stacked. Thus, the plurality of stacking slots allow the invention to be more securely stacked on top of one another. It is also contemplated that the lateral wall 8 may possess a bright color which draws attention to the invention, and thereby help to prevent a person from accidentally colliding with and knocking over the invention.

In an embodiment of the invention, the pair of pockets are directly attached to the lateral wall 8, and are intended to allow the invention to store and carry straws. Straws are commonly utilized in restaurants to allow customers to more easily consume their beverages. The pair of pockets may also be utilized to carry other tools necessary for the server to perform certain tasks. For example, the pair of pockets may be utilized to store and carry a bottle opener and a wine bottle opener such that the server is able to open practically any beverage container at the customer's table. As another example, the pair of pockets may be utilized to carry coasters and ticket books which are both utilized in the serving process. Each of the pair of pockets is positioned at either the left or right side of the lateral wall 8 with each comprising a thin sheet of material which is connected at either end to the lateral wall 8. Another sheet of material makes up the bottom of the pocket. The material used in the construction of the pocket may be rigid or flexible in the final embodiment of the invention.

In an embodiment of the invention, the organization panel is located some distance above the bottom panel 12. Furthermore, the organization panel is shaped such that it fit horizontally within the confines of the lateral wall 8. The shape and thickness of the organization panel may vary in the final embodiment of the invention. The purpose of the organization panel is to provide horizontal support for the plurality of beverages placed within the storage volume. Resultantly, the organization panel further comprises a plurality of slots which are evenly distributed throughout the organization panel. The purpose of the plurality of slots is to allow the plurality of beverages to be inserted into the storage volume through the organization panel. The bottoms of the plurality of beverages are supported by the bottom panel 12, and the plurality of slots work to prevent the plurality of beverages from sliding along the bottom panel 12 if the invention is tipped or bumped while in use. Furthermore, the plurality of slots help to prevent the plurality of beverages from falling out of the storage volume. This means that even should the invention be dropped, and the beverages spilled or destroyed, the mess is largely contained and clean up time is minimized. It is important to note that the plurality of slots may comprise many different sizes and shapes such that virtually any glass, mug, bottle, or cup may be carried safely within the invention. This versatility in the sizes and shapes of the plurality of beverages which can be carried is one of the major advantages of the invention.

In compliance with the object of the invention to be easily carried in one hand, the pair of handles 15 are present. The pair of handles 15 are intended to allow the invention to be easily carried, and comprise a loop and a hinge connection. The loop comprises a thin structural member which is bent into a roughly hemispherical shape. The loop is of sufficient diameter such that each end of the loop can be positioned flush with the lateral wall 8. The hinge connection allows the loop to be rotatably connected to the lateral wall 8. This ensures that the handle can be rotated down out of the way when the server wished to retrieve drinks form the storage volume. When the pair of handles 15 are in the folded up position, the invention can be easily carried in one hand by the server.

Although the invention has been explained in relation to its preferred embodiment, it is to be understood that many other possible modifications and variations can be made without departing from the spirit and scope of the invention as hereinafter claimed.

What is claimed is:

1. A beverage transport organizer comprises:

a beverage carrier;

an insert panel;

the beverage carrier comprises a lateral wall, a carrier opening, a bottom panel, stacking notches, an panel mount, a pair of handles, and a plurality of container pockets;

the insert panel comprises a carrier mount and a plurality of beverage holders;

the lateral wall comprises an inner wall and an outer wall;

each of the plurality of beverage holders comprises circular opening, a beverage handle opening, and a glassware stem holder;

the plurality of container pockets comprise partitions and ergonomic handles; and the insert panel being detachable mounted to the beverage carrier.

2. The beverage transport organizer as claimed in claim 1 comprises:

the carrier opening being bordered by the lateral wall;

the bottom panel being positioned opposite the carrier opening across the lateral wall;

the stacking notches being positioned on the lateral wall surrounding the carrier opening;

the panel mount being secured to the lateral wall between the carrier opening and the bottom panel;

the pair of handles being pivotably coupled to the lateral wall proximal to the carrier opening; and the plurality of container pockets being perimetrically positioned on the lateral wall.

3. The beverage transport organizer in claim 1 wherein, the bottom panel is recessed into the lateral wall opposite the carrier opening.

4. The beverage transport organizer as claimed in claim 1 comprises:

the stacking notches being spaced from one another a distance equal to the width of the bottom panel; and the insert panel being detachably engaged to the panel mount by way of the carrier mount.

5. The beverage transport organizer in claim 1 wherein, the plurality of beverage holders being symmetrically distributed on the insert panel.

6. The beverage transport organizer in claim 1 wherein, the beverage handle opening peripherally positioned to the circular opening.

7. The beverage transport organizer in claim 1 wherein, the glassware stem holder being peripherally positioned to the circular opening.

8. The beverage transport organizer in claim 1 wherein, the glassware stem holder comprises specific curvatures that engage a glassware stem preventing unwanted movement during transport.

9. The beverage transport organizer as claimed in claim 1 comprises:

the beverage carrier comprises an illumination device;

the illumination device being mounted to the outer wall; and the illumination device being optically disposed at an angle towards the ground, wherein the disposed vector of the illumination device is oriented downward towards the ground.

10. The beverage transport organizer as claimed in claim 1 comprises:

a secondary holder; and the secondary holder being removeably inserted into a beverage holder of the plurality of beverage holders, wherein the secondary holder is particularly sized to be partially sleeved by a beverage holder.

11. A beverage transport organizer comprises:

a beverage carrier;

an insert panel;

a secondary holder;

the beverage carrier comprises a lateral wall, a carrier opening, a bottom panel, stacking notches, an panel mount, a pair of handles, a plurality of container pockets, and an illumination device;

the insert panel comprises a carrier mount and a plurality of beverage holders;

the lateral wall comprises an inner wall and an outer wall;

each of the plurality of beverage holders comprises circular opening, a beverage handle opening, and a glassware stem holder;

the plurality of container pockets comprise partitions and ergonomic handles;

the insert panel being detachable mounted to the beverage carrier;

the carrier opening being bordered by the lateral wall;

the bottom panel being positioned opposite the carrier opening across the lateral wall;

the stacking notches being positioned on the lateral wall surrounding the carrier opening;

the panel mount being secured to the lateral wall between the carrier opening and the bottom panel;

the pair of handles being pivotably coupled to the lateral wall proximal to the carrier opening;

the plurality of container pockets being perimetrically positioned on the lateral wall;

the stacking notches being spaced from one another a distance equal to the width of the bottom panel; and the insert panel being detachably engaged to the panel mount by way of the carrier mount.

12. The beverage transport organizer as claimed in claim 11 comprises:

the plurality of beverage holders being symmetrically distributed on the insert panel;

the beverage handle opening peripherally positioned to the circular opening; and the glassware stem holder being peripherally positioned to the circular opening.

13. The beverage transport organizer in claim 11 wherein, the bottom panel being recessed into the lateral wall opposite the carrier opening.

14. The beverage transport organizer in claim 11 wherein, the glassware stem holder comprises specific curvatures that engage a glassware stem preventing unwanted movement during transport.

15. A beverage transport organizer comprises:

a beverage carrier;

an insert panel;

a secondary holder;

the beverage carrier comprises a lateral wall, a carrier opening, a bottom panel, stacking notches, an panel mount, a pair of handles, a plurality of container pockets, and an illumination device;

the insert panel comprises a carrier mount and a plurality of beverage holders;

the lateral wall comprises an inner wall and an outer wall;

each of the plurality of beverage holders comprises circular opening, a beverage handle opening, and a glassware stem holder;

the plurality of container pockets comprise partitions and ergonomic handles;

the insert panel being detachable mounted to the beverage carrier;

the carrier opening being bordered by the lateral wall;

the bottom panel being positioned opposite the carrier opening across the lateral wall;

the stacking notches being positioned on the lateral wall surrounding the carrier opening;

the panel mount being secured to the lateral wall between the carrier opening and the bottom panel;

the pair of handles being pivotably coupled to the lateral wall proximal to the carrier opening;

the plurality of container pockets being perimetrically positioned on the lateral wall;

the stacking notches being spaced from one another a distance equal to the width of the bottom panel;

the insert panel being detachably engaged to the panel mount by way of the carrier mount;

the plurality of beverage holders being symmetrically distributed on the insert panel;

the beverage handle opening peripherally positioned to the circular opening;

the glassware stem holder being peripherally positioned to the circular opening;

the bottom panel being recessed into the lateral wall opposite the carrier opening; and the glassware stem holder comprises specific curvatures that engage a glassware stem preventing unwanted movement during transport.

* * * * *